US011946707B2

(12) United States Patent
Hedberg

(10) Patent No.: US 11,946,707 B2
(45) Date of Patent: Apr. 2, 2024

(54) HEAT TRANSFER PLATE WITH UPPER DISTRIBUTION RIDGES HAVING CORNERS OF DIFFERENT CURVATURE RADIUS

(71) Applicant: ALFA LAVAL CORPORATE AB, Lund (SE)

(72) Inventor: Magnus Hedberg, Hjärup (SE)

(73) Assignee: ALFA LAVAL CORPORATE AB, Lund (SE)

( * ) Notice: Subject to any disclaimer, the term of this patent is extended or adjusted under 35 U.S.C. 154(b) by 0 days.

(21) Appl. No.: 18/253,218

(22) PCT Filed: Nov. 25, 2021

(86) PCT No.: PCT/EP2021/082951
§ 371 (c)(1),
(2) Date: May 17, 2023

(87) PCT Pub. No.: WO2022/128386
PCT Pub. Date: Jun. 23, 2022

(65) Prior Publication Data

US 2023/0332846 A1 Oct. 19, 2023

(30) Foreign Application Priority Data

Dec. 15, 2020 (EP) ..... 20214275

(51) Int. Cl.
*F28F 3/04* (2006.01)
*F28D 9/00* (2006.01)
(Continued)

(52) U.S. Cl.
CPC ..... *F28F 3/046* (2013.01); *F28F 3/083* (2013.01); *F28D 9/0062* (2013.01); *F28D 9/0068* (2013.01); *F28F 3/10* (2013.01)

(58) Field of Classification Search
CPC ..... F28F 9/22; F28F 3/10; F28F 3/046; F28F 3/083; F28F 3/04; F28D 9/0062; F28D 9/0068; F28D 9/005; F24F 1/0314
See application file for complete search history.

(56) References Cited

U.S. PATENT DOCUMENTS 4,434,643 A * 3/1984 Almqvist ..... F28F 3/083 72/466.8
5,727,118 A * 3/1998 Roussel ..... F24H 1/121 392/494

(Continued)

FOREIGN PATENT DOCUMENTS

CN 101178293 A 5/2008
CN 108827057 A 11/2018

(Continued)

OTHER PUBLICATIONS

International Search Report (PCT/ISA/210) dated Feb. 24, 2022 by the European Patent Office as the International Searching Authority for International Application No. PCT/EP2021/082951. (5 pages).

(Continued)

*Primary Examiner* — Paul Alvare
(74) *Attorney, Agent, or Firm* — BUCHANAN INGERSOLL & ROONEY PC

(57) ABSTRACT

A heat transfer plate comprises upper, center and lower end portions, the latter adjoining the center portion along an upper borderline and comprising first and second portholes and a distribution area having a distribution pattern. The distribution pattern comprises distribution ridges, a respective top portion of which extends in a plane and has rounded first, second, third and fourth corners. The distribution ridges extend along plural separated imaginary ridge lines from the upper borderline towards the first porthole. For each of a number of the distribution ridges extending along a top ridge line closest to the second porthole, the first corner's curva- (Continued)

ture radius is larger than the second corner's curvature radius, the first/second corners are on opposite sides of the top ridge line, the second corner is closer to the second porthole than the first corner, and the first/third corners are on the same side of the top ridge line.

14 Claims, 5 Drawing Sheets

(51) Int. Cl.
*F28F 3/08* (2006.01)
*F28F 3/10* (2006.01)

(56) References Cited

U.S. PATENT DOCUMENTS

| | | | | |
|---|---|---|---|---|
| 6,394,178 | B1 * | 5/2002 | Yoshida | F28F 3/046 165/DIG. 368 |
| 6,702,005 | B1 * | 3/2004 | Blomgren | F28F 3/046 165/906 |
| 7,490,660 | B2 * | 2/2009 | Song | F28F 3/10 165/166 |
| 9,217,608 | B2 | 12/2015 | Krantz et al. | |
| 9,400,142 | B2 | 7/2016 | Holm et al. | |
| 2004/0069473 | A1 * | 4/2004 | Blomgren | F28D 9/005 165/167 |
| 2007/0029077 | A1 * | 2/2007 | Mirolli | F28D 9/005 165/167 |
| 2008/0210414 | A1 * | 9/2008 | Blomgren | F28D 9/005 165/166 |
| 2011/0139419 | A1 * | 6/2011 | Blomgren | F28D 9/005 165/170 |
| 2011/0240273 | A1 * | 10/2011 | Blomgren | F28F 3/083 165/168 |
| 2012/0325434 | A1 * | 12/2012 | Blomgren | F28F 9/026 165/104.19 |
| 2015/0247682 | A1 * | 9/2015 | Nilsson | F28D 9/005 165/185 |
| 2015/0276319 | A1 * | 10/2015 | Hedberg | F28D 9/0093 165/166 |
| 2017/0067695 | A1 | 3/2017 | Wei et al. | |
| 2019/0204024 | A1 * | 7/2019 | Hedberg | F28D 9/005 |
| 2020/0278158 | A1 * | 9/2020 | Nilsson | F28F 3/08 |
| 2021/0310744 | A1 * | 10/2021 | Blomgren | F28D 9/005 |

FOREIGN PATENT DOCUMENTS

| | | | | |
|---|---|---|---|---|
| EP | 3043139 | A1 | 7/2016 | |
| EP | 2728292 | B1 | 10/2016 | |
| EP | 1899671 | B1 | 12/2016 | |
| EP | 3101376 | A1 | 12/2016 | |
| EP | 2957851 | B1 | 5/2017 | |
| EP | 3225947 | A1 * | 10/2017 | F28D 9/005 |
| EP | 3467423 | A1 | 4/2019 | |
| EP | 3587984 | A1 | 1/2020 | |
| EP | 3608620 | A2 | 2/2020 | |
| EP | 3650795 | A1 | 5/2020 | |
| EP | 3657114 | A1 | 5/2020 | |
| JP | S52000271 | B2 | 1/1977 | |
| JP | H06508426 | A | 9/1994 | |
| JP | H06281377 | A | 10/1994 | |
| JP | 2012-052800 | A | 3/2012 | |
| JP | 2017504780 | A | 2/2017 | |
| JP | 2020012630 | A | 1/2020 | |
| KR | 1020110002953 | A | 1/2011 | |
| WO | 9300563 | A1 | 1/1993 | |

OTHER PUBLICATIONS

Written Opinion (PCT/ISA/237) dated Feb. 24, 2022 by the European Patent Office as the International Searching Authority for International Application No. PCT/EP2021/082951. (7 pages).
Office Action (The First Office Action) dated Sep. 27, 2023, by the National Intellectual Property Administration, P. R. China in corresponding Chinese Patent Application No. 202180083852.X and an English translation of the Office Action. (11 pages).
Office Action (Decision to Grant a Patent) dated Jan. 22, 2024, in corresponding Japanese Patent Application No. 2023-536157 and English translation of the Office Action. (6 pages).
Office Action (Notice of Allowance) dated Jan. 29, 2024, in corresponding Korean Patent Application No. 10-2023-7024046 and English translation of the Office Action. (5 pages).

* cited by examiner

HEAT TRANSFER PLATE WITH UPPER DISTRIBUTION RIDGES HAVING CORNERS OF DIFFERENT CURVATURE RADIUS

TECHNICAL FIELD

The invention relates to a heat transfer plate and its design.

BACKGROUND ART

Plate heat exchangers, PHEs, typically consist of two end plates in between which a number of heat transfer plates are arranged aligned in a stack or pack. The heat transfer plates of a PHE may be of the same or different types and they may be stacked in different ways. In some PHEs, the heat transfer plates are stacked with the front side and the back side of one heat transfer plate facing the back side and the front side, respectively, of other heat transfer plates, and every other heat transfer plate turned upside down in relation to the rest of the heat transfer plates. Typically, this is referred to as the heat transfer plates being "rotated" in relation to each other. In other PHEs, the heat transfer plates are stacked with the front side and the back side of one heat transfer plate facing the front side and back side, respectively, of other heat transfer plates, and every other heat transfer plate turned upside down in relation to the rest of the heat transfer plates. Typically, this is referred to as the heat transfer plates being "flipped" in relation to each other.

In one type of well-known PHEs, the so called gasketed PHEs, gaskets are arranged between the heat transfer plates. The end plates, and therefore the heat transfer plates, are pressed towards each other by some kind of tightening means, whereby the gaskets seal between the heat transfer plates. Parallel flow passages are formed between the heat transfer plates, one passage between each pair of adjacent heat transfer plates. Two fluids of initially different temperatures, which are fed to/from the PHE through inlets/outlets, can flow alternately through every second passage for transferring heat from one fluid to the other, which fluids enter/exit the passages through inlet/outlet port holes in the heat transfer plates communicating with the inlets/outlets of the PHE.

Typically, a heat transfer plate comprises two end portions and an intermediate heat transfer portion. The end portions comprise the inlet and outlet port holes and distribution areas pressed with a distribution pattern of ridges and valleys. Similarly, the heat transfer portion comprises a heat transfer area pressed with a heat transfer pattern of ridges and valleys. The ridges and valleys of the distribution and heat transfer patterns of the heat transfer plate are arranged to contact, in contact areas, the ridges and valleys of distribution and heat transfer patterns of adjacent heat transfer plates in a plate heat exchanger. The main task of the distribution areas of the heat transfer plates is to spread a fluid entering the passage across the width of the heat transfer plates before the fluid reaches the heat transfer areas, and to collect the fluid and guide it out of the passage after it has passed the heat transfer areas. On the contrary, the main task of the heat transfer area is heat transfer.

Since the distribution areas and the heat transfer area have different main tasks, the distribution pattern normally differs from the heat transfer pattern. The distribution pattern may be such that it offers a relatively weak flow resistance and low pressure drop which is typically associated with a more "open" pattern design. Typically, the distribution pattern offers relatively few, but large, elongate contact areas, and relatively wide distribution flow tunnels across the distribution area, between adjacent heat transfer plates. The heat transfer pattern may be such that it offers a relatively strong flow resistance and high pressure drop which is typically associated with a more "dense" pattern design offering more, but smaller, point-shaped contact areas between adjacent heat transfer plates.

Even if the conventional distribution patterns are designed to provide an effective fluid spreading and collecting, they typically form distribution flow tunnels of different distance to the inlet and outlet port holes of adjacent plates, and of different length or longitudinal extension across the distribution areas between adjacent plates. The distribution flow tunnels are defined by two opposing flow channels of two adjacent plates. Typically, larger distance from the inlet and outlet port holes and longer distribution flow tunnels are associated with smaller fluid flow and an increased presence of areas with relatively stagnant fluid flow. These stagnant flow areas are more prone to fouling and dirt build-up which is disadvantageous inter alia from a hygiene perspective as well as a heat transfer capacity perspective.

SUMMARY

An object of the present invention is to provide a heat transfer plate which at least partly solves the above discussed problem of prior art. The basic concept of the invention is to locally, where the distribution area of the heat transfer plate is most prone to fouling and dirt build-up, adjust the design of the distribution area to reduce the presence of stagnant flow areas and thereby the risk of fouling and dirt build-up. The heat transfer plate, which is also referred to herein as just "plate", for achieving the object above is defined in the appended claims and discussed below.

A heat transfer plate according to the invention extends in an imaginary central extension plane and comprises an upper end portion, a center portion and a lower end portion arranged in succession along a longitudinal center axis of the heat transfer plate. The upper end portion comprises a first and a second port hole and an upper distribution area provided with an upper distribution pattern. The lower end portion comprises a third and a fourth port hole and a lower distribution area provided with a lower distribution pattern. The center portion comprises a heat transfer area provided with a heat transfer pattern differing from the upper and lower distribution patterns. The upper end portion adjoins the center portion along an upper borderline and the lower end portion adjoins the center portion along a lower borderline. The upper distribution pattern comprises elongate upper distribution ridges and elongate upper distribution valleys. A respective top portion of the upper distribution ridges extends in an imaginary upper plane and has a rounded first, a rounded second, a rounded third and a rounded fourth corner. A respective bottom portion of the upper distribution valleys extends in an imaginary lower plane and has a rounded first, a rounded second, a rounded third and a rounded fourth corner. The upper distribution ridges longitudinally extend along a plurality of separated imaginary upper ridge lines extending from the upper borderline towards the first port hole. The upper distribution valleys longitudinally extend along a plurality of separated imaginary upper valley lines extending from the upper borderline towards the second port hole. The heat transfer plate is characterized in that a curvature radius of the first corner of the top portion is larger, or essentially larger, than a curvature radius of the second corner of the top portion for each of a first number>1 of the upper distribution ridges extending along a top upper ridge line of the upper ridge lines, which top upper ridge line is arranged closest to the second porthole. The first and second corners are arranged on opposite sides of the top upper ridge line, the second corner is arranged closer to the second porthole than the first corner. Further, the first and third corners are arranged on the same side of the top upper ridge line.

Herein, if not stated otherwise, the ridges and valleys of the heat transfer plate are ridges and valleys when the front side of the heat transfer plate is viewed. Naturally, what is a ridge as seen from the front side of the plate is a valley as seen from the opposing back side of the plate, and what is a valley as seen from the front side of the plate is a ridge as seen from the back side of the plate, and vice versa.

Throughout the text, when referring to e.g. a line extending from something towards "something else", the line does not have to extend straight, but may extend obliquely or curved, towards "something else".

Herein, by plurality, is meant more than one.

Hereinafter, by "contact area" is meant the area of the heat transfer plate arranged to contact adjacent heat transfer plates when arranged properly in a plate pack. The contact area, which comprises numerous sub contact areas scattered over the heat transfer plate, must be sufficiently large or else the plate pack will be weak and prone to deformation.

Some or all of the upper distribution ridges extending along the top upper ridge line may be comprised in said first number.

The central extension plane extends between the upper and lower planes, and the central extension plane, upper plane and lower plane may be parallel.

The upper and lower planes may or may not be extreme planes of the heat transfer plate, extreme planes being planes beyond which a center of the heat transfer plate does not extend.

Since the heat transfer plate is typically made by pressing metal sheet, the ridges and valleys of the heat transfer plate are not formed with sharp or 90 degrees edges and corners. Therefore, the first, second, third and fourth corners of the top portions and bottom portions of the upper distribution ridges and the upper distribution valleys will always be rounded to some degree. It is typically preferred to have the curvature radius of the first, second, third and four corners as small as possible so as to facilitate achievement of relatively large contact areas between the heat transfer plate and adjacent heat transfer plates in a plate pack of a plate heat exchanger. By varying the curvature radius of the first, second, third and fourth corners of the top portion for a plurality of the upper distribution ridges locally in an area of the upper distribution pattern which is prone to fouling and dirt build-up, like the area along the top upper ridge line, the heat transfer plate may be optimized as regards anti-fouling as well as space efficient, sufficient contact area.

According to one embodiment of the heat transfer plate said first number of the upper distribution ridges is a majority of the upper distribution ridges extending along the top upper ridge line. In other words, according to this embodiment, a majority of the upper distribution ridges extending along the top upper ridge line have first, second, third and four corners with varying curvature radius which may minimize the tendency of fouling and dirt build-up with maintained space efficient, sufficient contact area.

The heat transfer plate may be so designed that a curvature radius of the third corner of the top portion is larger, or essentially larger, than a curvature radius of the fourth corner of the top portion for each of said first number of the upper distribution ridges. This means that the curvature radius is varied at both ends of each of said first number of the upper distribution ridges. Thereby, the heat transfer plate may be even further optimized as regards anti-fouling as well as space efficient, sufficient contact area.

The heat transfer plate may be such that the top portion, between the first and third corners, bulges towards, or is convex as seen from, the upper ridge line arranged second closest to the second porthole, for each of said first number of the upper distribution ridges. According to this embodiment the top portions of said first number of the upper distribution ridges may have the essential form of a half circle or oval, symmetric or not, as seen from above the plate. Such an embodiment may enable a minimized presence of stagnant flow areas and thereby a minimized risk of fouling and dirt build-up.

As an alternative to the above, the heat transfer plate may be such that the top portion of each of said first number of the upper distribution ridges comprises a first end part, an intermediate part and a second end part arranged in succession along the top upper ridge line, wherein the first end part comprises the first and second corners and the second end part comprises the third and fourth corners, and wherein the intermediate part has an essentially constant width, the width being measured orthogonal to the top upper ridge line. According to this embodiment the top portions of said first number of the upper distribution ridges may have a straight edge between the first and third corners. Such an embodiment may enable an optimized heat transfer plate as regards space efficient, sufficient contact area.

The heat transfer plate may further comprise a front upper diagonal gasket groove portion arranged between the second port hole and the upper distribution area. A bottom of the front upper diagonal gasket groove portion may extend in an imaginary front diagonal gasket plane, and the upper distribution ridges, which extend along the top upper ridge line, may protrude from the imaginary front diagonal gasket plane and extend along the front upper diagonal gasket groove portion so as to form an intermittent side wall of the front upper diagonal gasket groove portion. According to this embodiment, the front upper diagonal gasket groove portion borders on the second corner, the fourth corner and an edge extending therebetween, of the top portions of the upper distribution ridges extending along the top upper ridge line. By varying the curvature radius of the first, second, third and fourth corners according to the present invention, the upper distribution ridges may also provide optimized support for a gasket portion arranged in the front upper diagonal gasket groove portion.

The imaginary front diagonal gasket plane may coincide with the imaginary lower plane. However, according to one embodiment of the invention, said imaginary front diagonal gasket plane extends between, and possibly parallel to, the imaginary upper plane and the imaginary lower plane. Such an embodiment may enable a pack of plates, which are designed according to the present invention, being "flipped" as well as "rotated" in relation to each other.

The heat transfer plate may be such that the imaginary upper ridge lines and the imaginary upper valley lines form a grid within the upper distribution area. The upper distribution valleys and the upper distribution ridges defining each mesh of the grid may enclose an area within which the heat transfer plate may extend in an imaginary first intermediate plane extending between, and possibly parallel to, the imaginary upper plane and the imaginary lower plane. A mesh may be open or closed. Accordingly, the upper distribution pattern may be a so-called chocolate pattern which typically is associated with an effective flow distribution across the heat transfer plate.

The heat transfer plate may be such that a projection, in a first projection plane parallel to said central extension plane of the heat transfer plate, of the bottom portion of each of a plurality of the upper distribution valleys extending along a top upper valley line of the upper valley lines, which top upper valley line is arranged closest to the first porthole, is a mirroring, parallel to the longitudinal center axis of the heat transfer plate, of a projection, in said first projection plane, of the top portion of a respective one of said first number of the upper distribution ridges. Such an embodiment may enable an optimization as regards abutment between adjacent plates in a plate pack comprising heat transfer plates according to the present invention.

The first projection plane is imaginary.

According to one embodiment of the heat transfer plate according to the invention the first and the third port hole are arranged at one and the same side of the longitudinal center axis of the heat transfer plate. Further, the lower distribution pattern comprises elongate lower distribution ridges and elongate lower distribution valleys. The lower distribution ridges longitudinally extend along a plurality of separated imaginary lower ridge lines extending from the lower borderline towards one of the third and the fourth port holes. The lower distribution valleys longitudinally extend along a plurality of separated imaginary lower valley lines extending from the lower borderline towards the other one of the third and the fourth port hole. A projection, in a second projection plane parallel to said central extension plane of the heat transfer plate, of a top portion or a bottom portion of each of a plurality of the lower distribution ridges and lower distribution valleys, is a mirroring, parallel to a transverse center axis of the heat transfer plate, of a projection, in said second projection plane, of the top portion of a respective one of said first number of the upper distribution ridges. Such an embodiment may enable an optimization as regards abutment between adjacent plates in a plate pack comprising heat transfer plates according to the present invention.

Said plurality of the lower distribution ridges and lower distribution valleys may either all be lower distribution ridges or all be lower distribution valleys.

The second projection plane is imaginary and may coincide with the first projection plane.

With reference to the embodiment above, said one of the third and the fourth port hole may be the third porthole and said other one of the third and the fourth port hole may be the fourth porthole. Thereby, the imaginary lower ridge lines may extend from the lower borderline towards the third port hole while the imaginary lower valley lines may extend from the lower borderline towards the fourth port hole. Further, each of a plurality of the lower distribution ridges extending along a bottom lower ridge line of the lower ridge lines, which bottom lower ridge line is arranged closest to the fourth porthole, may be a mirroring, parallel to the transverse center axis of the heat transfer plate, of a respective one of said first number of the upper distribution ridges. Such an embodiment may enable an optimization as regards abutment between adjacent plates in a plate pack comprising heat transfer plates according to the present invention, which plates are of so-called parallel flow type. A parallel-flow heat exchanger may comprise only one plate type.

Alternatively, said one of the third and the fourth port hole may be the fourth porthole and said other one of the third and the fourth port hole may the third porthole. Thereby, the imaginary lower ridge lines may extend from the lower borderline towards the fourth port hole while the imaginary lower valley lines may extend from the lower borderline towards the third port hole. Further, a projection, in the second projection plane, of the bottom portion of each of a plurality of the lower distribution valleys extending along a bottom lower valley line of the lower valley lines, which bottom lower valley line is arranged closest to the fourth porthole, may be a mirroring, parallel to the transverse center axis of the heat transfer plate, of a projection, in the second projection plane, of the top portion of a respective one of said first number of the upper distribution ridges. Such an embodiment may enable an optimization as regards abutment between adjacent plates in a plate pack comprising heat transfer plates according to the present invention, which plates are of so-called diagonal flow type. A diagonal-flow heat exchanger may typically comprise more than one plate type.

The heat transfer plate may be so designed that a plurality of the imaginary upper ridge lines arranged closest to the second port hole, along at least part of their extension, are curved so as to bulge out as seen from the second porthole. This may contribute to an effective flow distribution across the heat transfer plate.

The upper and lower borderlines may be non-straight, i.e. extend non-perpendicularly to the longitudinal center axis of the heat transfer plate. Thereby, the bending strength of the heat transfer plate may be increased as compared to if the upper and lower borderlines instead were straight in which case the upper and lower borderlines could serve as bending lines of the heat transfer plate. For example, the upper and lower borderlines may be curved or arched or concave so as to bulge in as seen from the heat transfer area. Such curved upper and lower borderlines are longer than corresponding straight upper and lower borderlines would be, which results in a larger "outlet" and a larger "inlet" of the distribution areas. In turn, this may contribute to an effective flow distribution across the heat transfer plate.

It should be stressed that the advantages of most, if not all, of the above discussed features of the inventive heat transfer plate appear when the heat transfer plate is combined with other suitably constructed heat transfer plates in a plate pack, especially other heat transfer plates according to the present invention.

Still other objectives, features, aspects and advantages of the invention will appear from the following detailed description as well as from the drawings.

BRIEF DESCRIPTION OF THE DRAWINGS

The invention will now be described in more detail with reference to the appended schematic drawings, in which FIG. 1 schematically illustrates a plan view of a heat transfer plate.

It should be said that all of the figures referred to above, except FIG. 2, illustrate a tool for pressing a heat transfer plate according to the invention, and not the heat transfer plate itself. Therefore, the figures may not consistently show the heat transfer plate with 100% accuracy.

DETAILED DESCRIPTION

Figure 1:
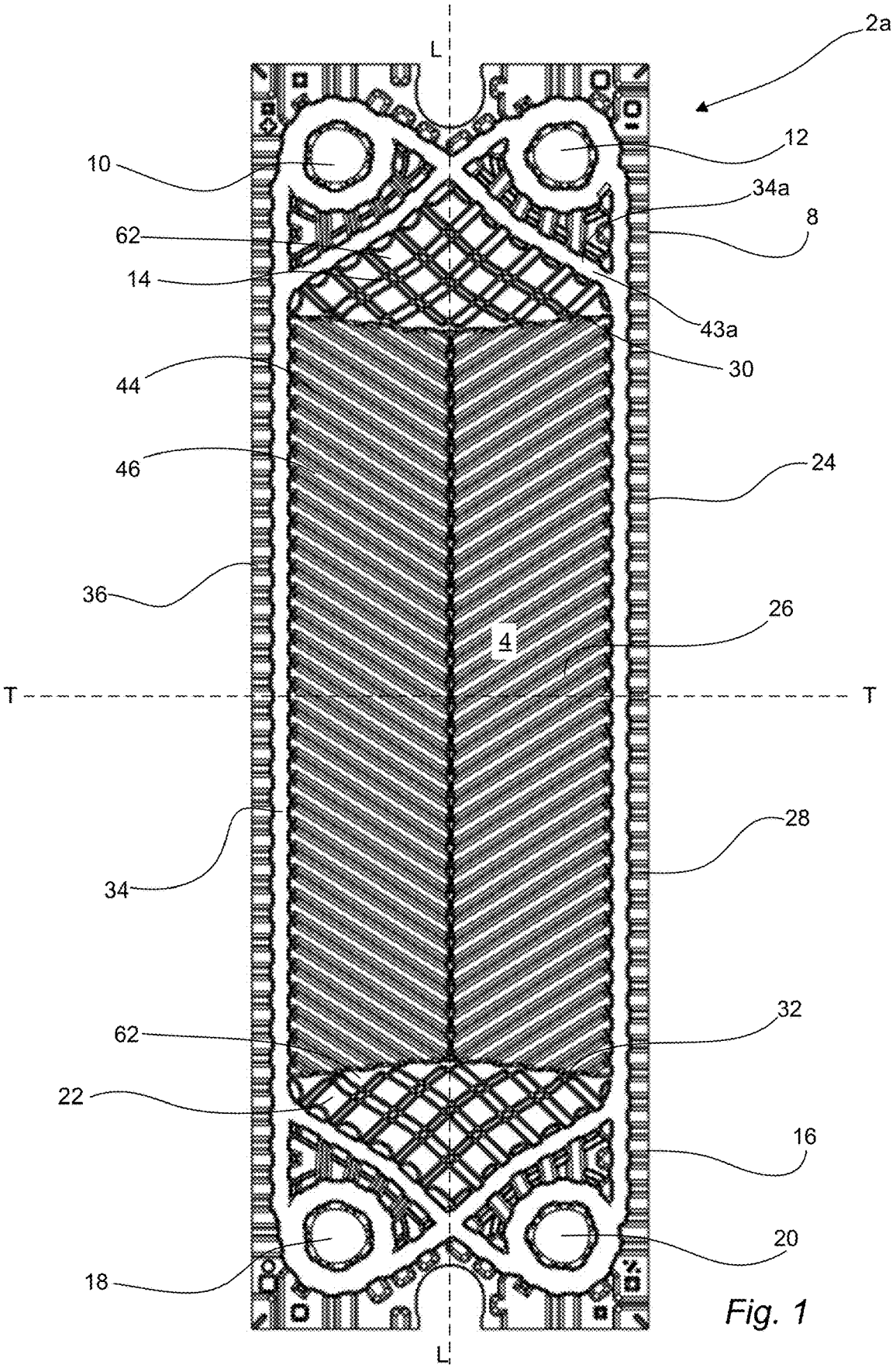
Figure 2:
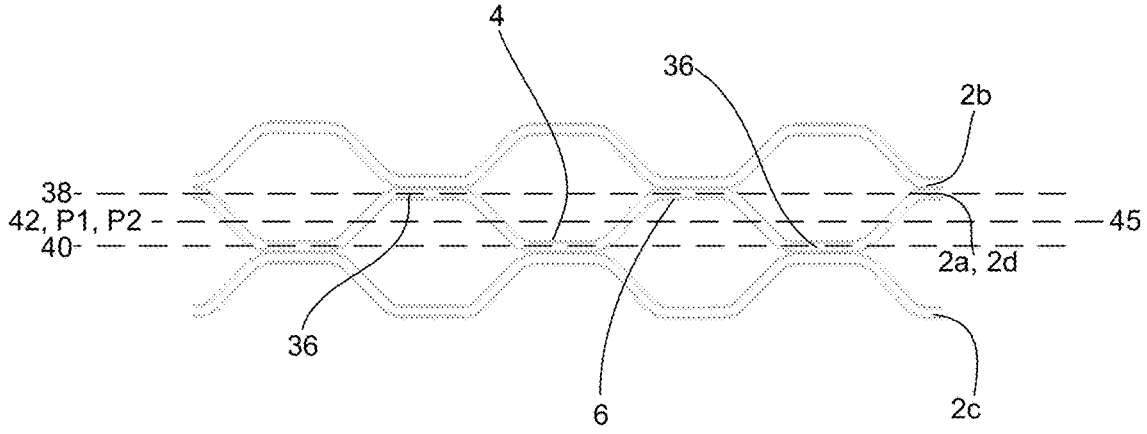
FIG. 2 illustrates abutting outer edges of adjacent heat transfer plates in a plate pack, as seen from the outside of the plate pack, FIG. 3*a* contains an enlargement of an upper distribution area of the heat transfer plate illustrated in FIG. 1, FIG. 3*b* contains an enlargement of a lower distribution area of the heat transfer plate illustrated in FIG. 1, FIG. 4*a-d* schematically illustrate cross sections through the upper and the lower distribution area of the heat transfer plate illustrated in FIG. 1, FIG. 5 contains enlargements of an upper distribution ridge and an upper distribution valley arranged in a center portion of the upper distribution area of the heat transfer plate illustrated in FIG. 1, FIG. 6 contains an enlargement of an upper distribution ridge extending along a top upper ridge line in the upper distribution area of the heat transfer plate illustrated in FIG. 1, and FIG. 7 contains an enlargement of an upper distribution valley extending along a top upper valley line in the upper distribution area of the heat transfer plate illustrated in FIG. 1.

FIG. 1 shows a heat transfer plate 2*a* of a gasketed plate heat exchanger as described by way of introduction. The gasketed PHE, which is not illustrated in full, comprises a pack of heat transfer plates 2 like the heat transfer plate 2*a*, i.e. a pack of similar heat transfer plates, separated by gaskets, which also are similar and which are not illustrated. With reference to FIG. 2, in the plate pack, a front side 4 (illustrated in FIG. 1) of the plate 2*a* faces an adjacent plate 2*b* while a back side 6 (not visible in FIG. 1 but indicated in FIG. 2) of the plate 2*a* faces another adjacent plate 2*c*.

With reference to FIG. 1, the heat transfer plate 2*a* is an essentially rectangular sheet of stainless steel. It comprises an upper end portion 8, which in turn comprises a first port hole 10, a second port hole 12 and an upper distribution area 14. The plate 2*a* further comprises a lower end portion 16, which in turn comprises a third port hole 18, a fourth port hole 20 and a lower distribution area 22. The lower end portion 16 is a mirroring, parallel to a transverse center axis T of the heat transfer plate 2*a*, of the upper end portion 8. The plate 2*a* further comprises a center portion 24, which in turn comprises a heat transfer area 26, and an outer edge portion 28 extending around the upper and lower end portions 8 and 16 and the center portion 24. The upper end portion 8 adjoins the center portion 24 along an upper borderline 30 while the lower end portion 16 adjoins the center portion 24 along a lower borderline 32. The upper and lower borderlines 30 and 32 are arched so as to bulge towards each other. As is clear from FIG. 1, the upper end portion 8, the center portion 24 and the lower end portion 16 are arranged in succession along a longitudinal center axis L of the plate 2*a*, which extends perpendicular to the transverse center axis T of the plate 2*a*. As is also clear from FIG. 1, the first and third port holes 10 and 18 are arranged on one and the same side of the longitudinal center axis L, while the second and fourth port holes 12 and 20 are arranged on one and the other side of the longitudinal center axis L. Also, the heat transfer plate 2*a* comprises, as seen from the front side 4, a front gasket groove 34 and, as seen from the back side 6, a back gasket groove (not illustrated). The front gasket groove 34 comprises a front upper diagonal gasket groove portion 34*a* arranged between the second porthole 12 and the upper distribution area 14. The back gasket groove comprises a back upper diagonal gasket groove portion (not illustrated) arranged between the first porthole 10 and the upper distribution area 14. The front and back gasket grooves are partly aligned with each other and arranged to receive a respective gasket.

The heat transfer plate 2*a* is pressed, in a conventional manner, in a pressing tool, to be given a desired structure, more particularly different corrugation patterns within different portions of the heat transfer plate. As was discussed by way of introduction, the corrugation patterns are optimized for the specific functions of the respective plate portions. Accordingly, the upper distribution area 14 is provided with an upper distribution pattern of so-called chocolate type, the lower distribution area 22 is provided with a lower distribution pattern of so-called chocolate type, and the heat transfer area 26 is provided with a heat transfer pattern. Further, the outer edge portion 28 comprises corrugations 36 which make the outer edge portion stiffer and, thus, the heat transfer plate 2*a* more resistant to deformation. Further, the corrugations 36 form a support structure in that they are arranged to abut corrugations of the adjacent heat transfer plates in the plate pack of the PHE. With reference also again to FIG. 2, illustrating the peripheral contact between the heat transfer plate 2*a* and the two adjacent heat transfer plates 2*b* and 2*c* of the plate pack, the corrugations 36 extend between and in an imaginary upper plane 38 and an imaginary lower plane 40, which are parallel to the figure plane of FIG. 1. An imaginary central extension plane 42 extends half way between the upper and lower planes 38 and 40. A bottom 43*a* of the front upper diagonal gasket groove portion 34*a* extends in an imaginary front diagonal gasket plane coinciding with the central extension plane 42. A bottom of the back upper diagonal gasket groove portion extends in an imaginary back diagonal gasket plane also coinciding with the central extension plane 42. In alternative embodiments the front and back diagonal gasket planes could be located differently.

With reference to FIGS. 1 and 2, the heat transfer pattern is of so-called herringbone type and comprises V-shaped heat transfer ridges 44 and heat transfer valleys 46 alternately arranged along the longitudinal center axis L and extending between and in the upper plane 38 and the lower plane 40. The heat transfer ridges and valleys 44 and 46 are symmetrical with respect to the central extension plane 42. Consequently, within the heat transfer area 26, a volume enclosed by the plate 2*a* and the upper plane 38 is similar to a volume enclosed by the plate 2*a* and the lower plane 40. In an alternative embodiment the heat transfer ridges and valleys 44 and 46 could instead be asymmetrical with respect to the central extension plane 42 so as to provide a volume enclosed by the plate 2*a* and the upper plane 38 which is different from a volume enclosed by the plate 2*a* and the lower plane 40.

Figure 3A:
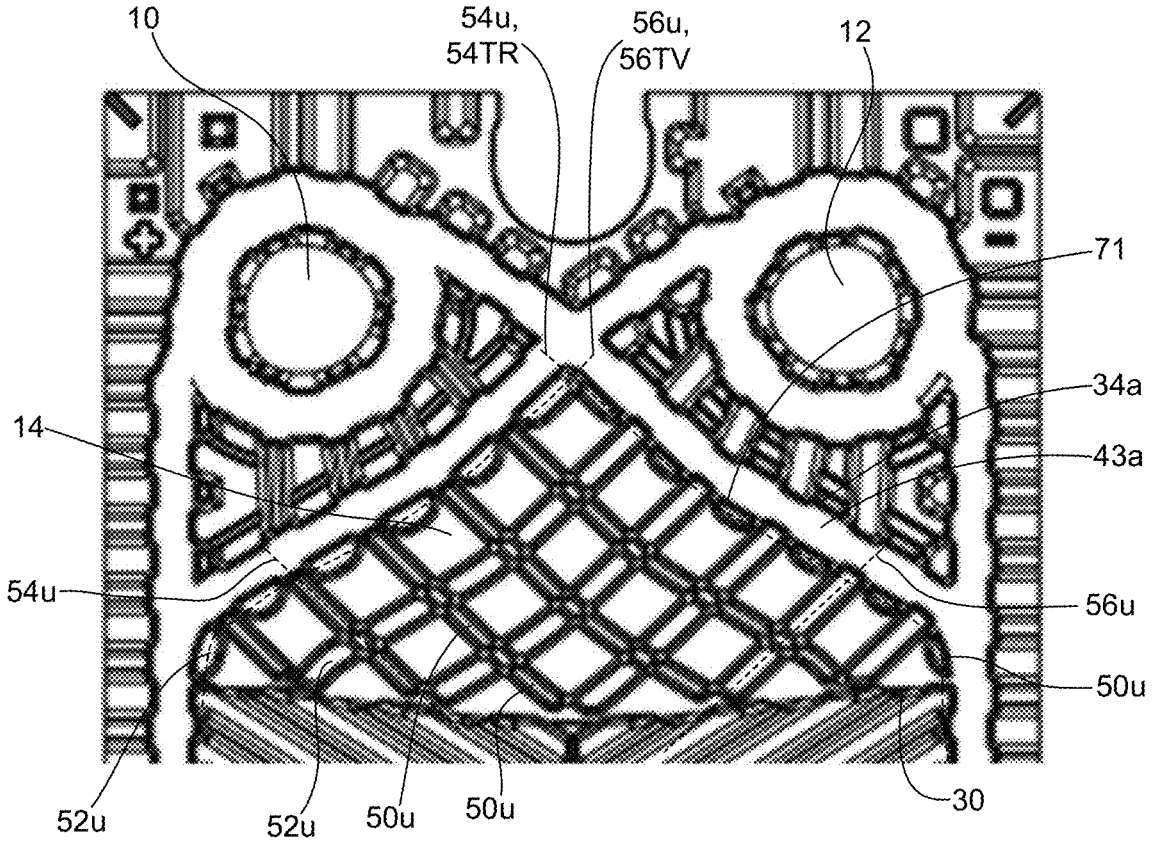
Figure 3B:
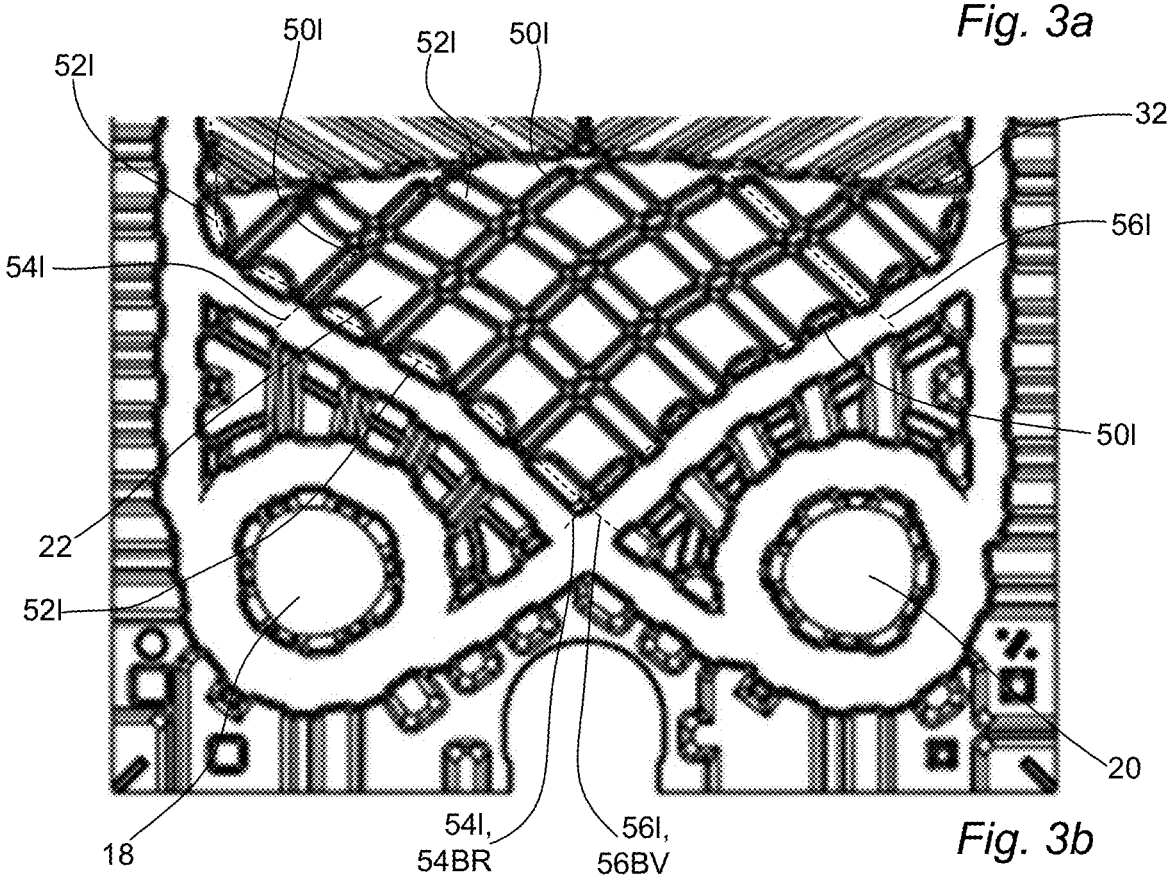

With reference to FIGS. 3*a* and 3*b* which show enlargements of parts of the plate 2*a*, the upper and lower distribution patterns within the upper and lower distribution areas 14 and 22 each comprise elongate upper and lower distribution ridges 50*u* and 50*l*, respectively, and elongate upper and lower distribution valleys 52*u* and 52*l*, respectively. The upper and lower distribution ridges 50*u*, 501 are divided into groups containing a plurality, i.e. two or more, upper or lower distribution ridges 50*u*, 501 each. The upper and lower distribution ridges 50*u*, 501 of each group are arranged, longitudinally extending, along one of a number of separated imaginary upper and imaginary lower ridge lines 54*u* and 54*l*, respectively, of which only a few are illustrated by broken lines in FIGS. 3*a* and 3*b*. Similarly, the upper and lower distribution valleys 52*u*, 52*l* are divided into groups. The upper and lower distribution valleys 52*u*, 52*l* of each group are arranged, longitudinally extending, along one of a number of separated imaginary upper and lower valley lines 56*u* and 56*l*, respectively, of which only a few are illustrated by broken lines in FIGS. 3*a* and 3*b*. As is illustrated in FIG. 3*a*, in the upper distribution area 14 the imaginary upper ridge lines 54*u* extend from the upper borderline 30 towards the first porthole 10 while the imaginary upper valley lines

56*u* extend from the upper borderline 30 towards the second porthole 12. Similarly, as is illustrated in FIG. 3*b*, in the lower distribution area 22 the imaginary lower ridge lines 541 extend from the lower borderline 32 towards the third porthole 18 while the imaginary lower valley lines 561 extend from the lower borderline 32 towards the fourth porthole 20.

Figure 4A:
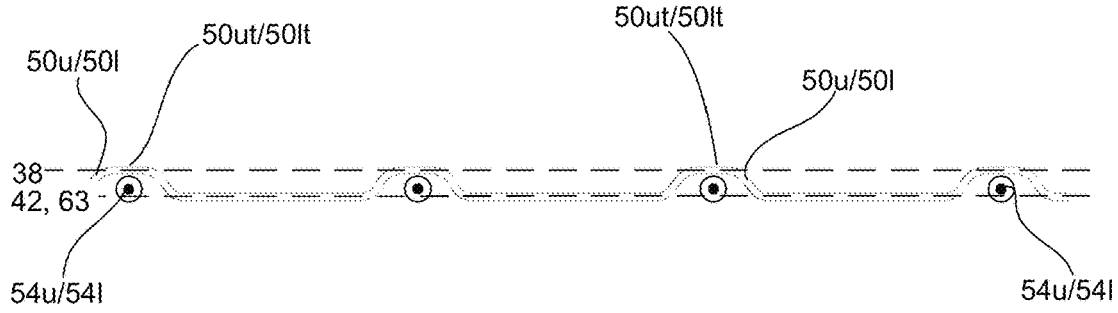
Figure 4B:
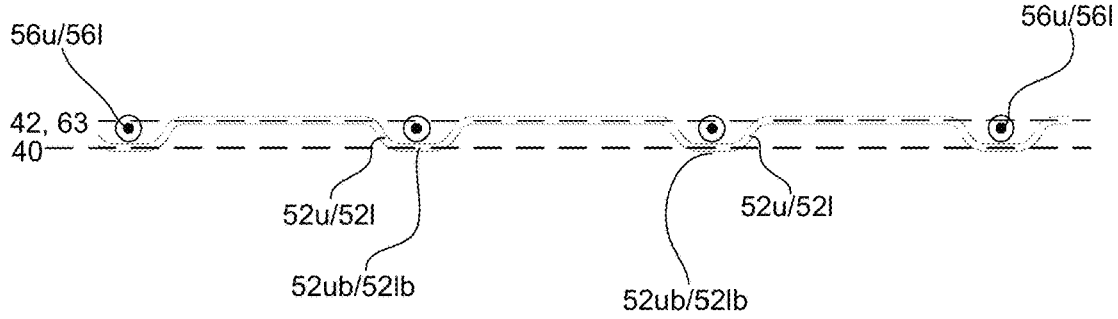
Figure 4C:
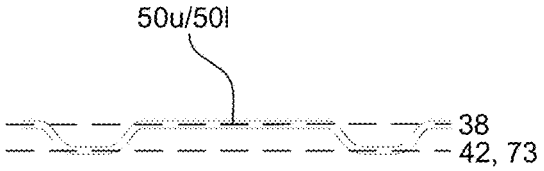
Figure 4D:
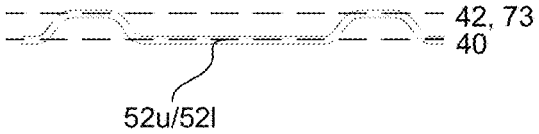

FIGS. 4*a*-4*d* schematically illustrate cross sections of the upper and lower distribution areas 14 and 22. With reference to FIGS. 3*a* and 3*b*, FIG. 4*a* shows cross sections of the plate between two adjacent ones of the imaginary upper valley lines 56*u* or between two adjacent ones of the imaginary lower valley lines 56*l*, while FIG. 4*b* shows cross sections of the plate between two adjacent ones of the imaginary upper ridge lines 54*u* or between two adjacent ones of the imaginary lower ridge lines 54*l*. Further, FIG. 4*c* shows cross sections of the plate along one of the imaginary upper or lower ridge lines 54*u*, 54*l*, while FIG. 4*d* shows cross sections of the plate along one of the imaginary upper or lower valley lines 56*u*, 56*l*.

The imaginary upper ridge and valley lines 54*u* and 56*u* cross each other to form an imaginary grid within the upper distribution area 14. Similarly, the imaginary lower ridge and valley lines 541 and 561 cross each other to form an imaginary grid within the lower distribution area 22. The upper and lower distribution ridges and distribution valleys 50*u*, 50*l*, 52*u* and 52*l* defining each mesh of the grids enclose a respective area 62 (FIG. 1). The meshes along the upper and lower borderlines 30 and 32 are open while the rest of the meshes are closed. With reference to FIGS. 4*a*-4*d* and FIG. 5, which illustrates a portion of the upper distribution area 14, a respective top portion 50*ut* and 50*lt* of the upper and lower distribution ridges 50*u* and 501 extends in the upper plane 38 and has rounded first, second, third and fourth corners 64, 66, 68 and 70. The first and second corners 64 and 66 are comprised in a respective first end part of the top portion 50*ut* and 50*lt* of the upper and lower distribution ridges 50*u* and 50*l*, and the third and fourth corners 68 and 70 are comprised in a respective second end part 67 of the top portion 50*ut* and 50*lt* of the upper and lower distribution ridges 50*u* and 50*l*. The first and second end parts 65 and 67 are arranged on opposite sides of a respective intermediate part 69 of the top portion 50*ut* and 50*lt* of the upper and lower distribution ridges 50*u* and 50*l*. Analogously, a respective bottom portion 52*ub* and 52*lb* of the upper and lower distribution valleys 52*u* and 52*l* extends in the lower plane 40 and has rounded first, second, third and fourth corners 74, 76, 78 and 80. The first and second corners 74 and 76 are comprised in a respective first end part 75 of the bottom portion 52*ub* and 52*lb* of the upper and lower distribution valleys 52*u* and 52*l*, and the third and fourth corners 78 and 80 are comprised in a respective second end part 77 of the bottom portion 52*ub* and 52*lb* of the upper and lower distribution ridges 52*u* and 521. The first and second end parts 75 and 77 are arranged on opposite sides of a respective intermediate part 79 of the bottom portion 52*ub* and 52*lb* of the upper and lower distribution ridges 52*u* and 521.

Within the areas 62 the heat transfer plate 2*a* extends in an imaginary first intermediate plane 63. Between two adjacent ones of the upper distribution ridges 50*u* or the lower distribution ridges 501 or the upper distribution valleys 52*u* or the lower distribution valleys 52*l*, i.e. at cross points of the imaginary grids within the upper and lower distribution areas 14 and 22, the heat transfer plate 2*a* extends in an imaginary second intermediate plane 73. Here, the imaginary first intermediate plane 63 and second intermediate plane 73 coincide with the central extension plane 42. Consequently, within the upper and lower distribution areas 14 and 22, a volume enclosed by the plate 2*a* and the upper plane 38 is similar to a volume enclosed by the plate 2*a* and the lower plane 40. In an alternative embodiment the first and second intermediate planes 63 and 73 could instead be displaced from the central extension plane 42 so as to provide a volume enclosed by the plate 2*a* and the upper plane 38 which is different from a volume enclosed by the plate 2*a* and the lower plane 40.

As is shown in FIGS. 3*a* and 3*b*, the imaginary upper and lower ridge and valley lines 54*u*, 541 and 56*u* and 561 with the largest groups of distribution ridges and valleys, i.e. the longer imaginary upper and lower ridge and valley lines, are curved so as to bulge out towards the respective one of the upper and lower borderlines 30 and 32. The imaginary upper and lower ridge and valley lines 54*u*, 541 and 56*u* and 561 with the smallest groups of distribution ridges and valleys, i.e. the shorter imaginary upper and lower ridge and valley lines, are essentially straight.

The longest one of the imaginary upper ridge lines 54*u*, which is the imaginary upper ridge line arranged closest to the second porthole 12, is hereinafter referred to as the top upper ridge line 54TR. The longest one of the imaginary upper valley lines 56*u*, which is the imaginary valley ridge line arranged closest to the first porthole 10, is hereinafter referred to as the top upper valley line 56TV. The longest one of the imaginary lower ridge lines 54*l*, which is the imaginary lower ridge line arranged closest to the fourth porthole 20, is hereinafter referred to as the bottom lower ridge line 54BR. The longest one of the imaginary lower valley lines 56*l*, which is the imaginary lower valley line arranged closest to the third porthole 18, is hereinafter referred to as the bottom lower valley line 56BV.

Figure 5:
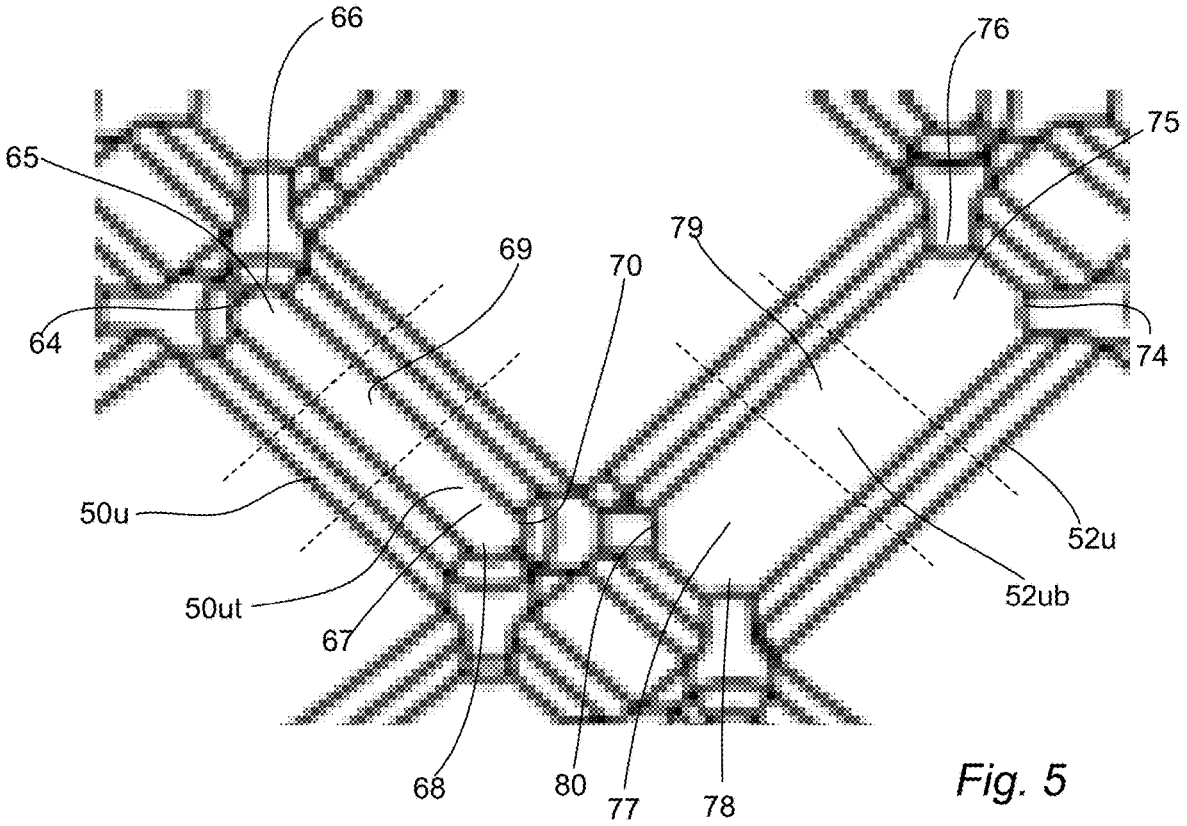
Figure 6:
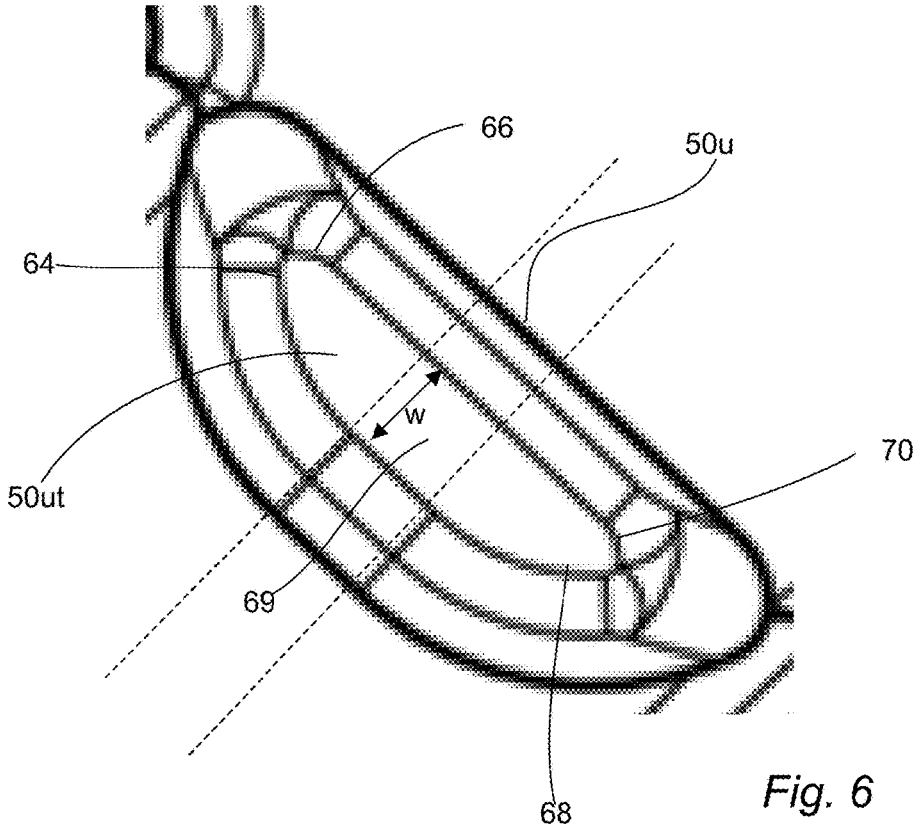
Figure 7:
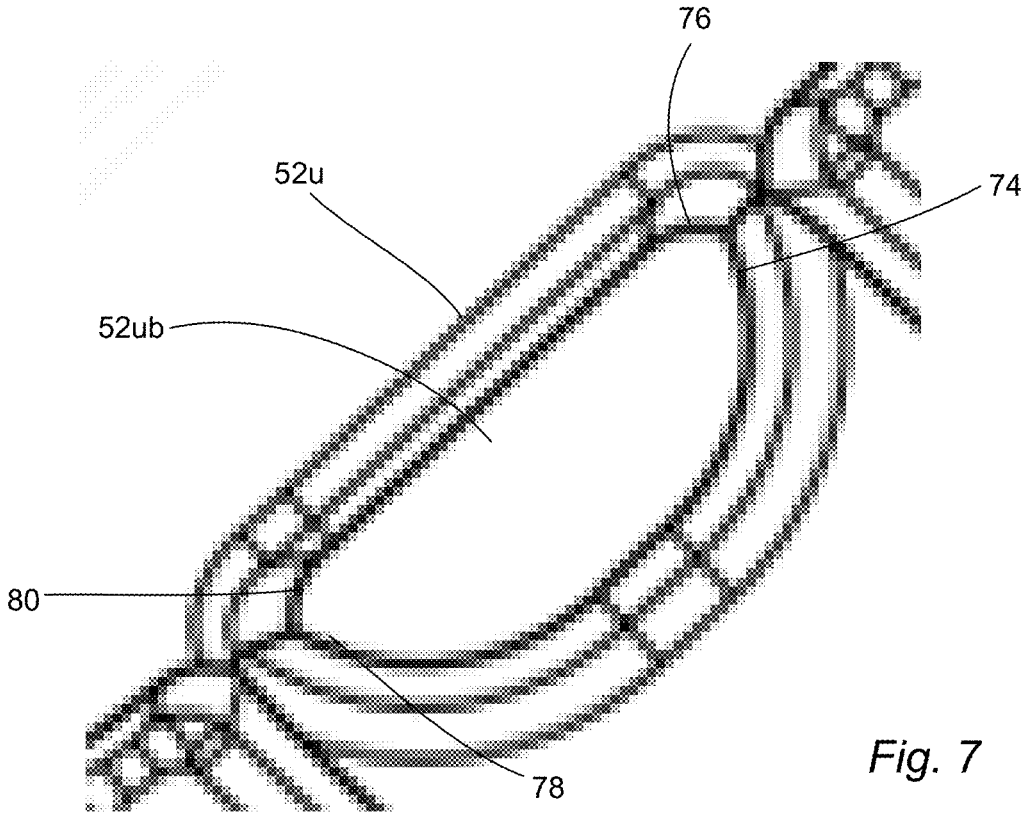

The top and bottom portions 50*ut*, 50*lt*, 52*ub*, 52*lb* of a majority of the upper and lower distribution ridges 50*u*, 501 and the upper and lower distribution valleys 52*u*, 52*l* are essentially quadrangular, as is illustrated in FIG. 5. However, this is not true for a first number, here all, of the upper distribution ridges 50*u* extending along the top upper ridge line 54TR, which protrude from the imaginary front diagonal gasket plane 45 and extend along the front upper diagonal gasket groove portion 34*a* to form an intermittent side wall 71 (FIG. 3*a*) of the front upper diagonal gasket groove portion 34*a*. Instead, as is illustrated in FIG. 6, the top portion 50*ut* of each of the upper distribution ridges 50*u* extending along the top upper ridge line 54TR is so designed that a curvature radius r1 for the first corner 64 is essentially larger than a curvature radius r2 for the second corner 66, and a curvature radius r3 for the third corner 68 is essentially larger than a curvature radius r4 for the fourth corner 70. Here, r1 and r3 are essentially equal while r2 and r4 are essentially equal. This may not be the case in other embodiments of the invention. Further, between the first corner 64 and the third corner 68, and between the third corner 66 and the fourth corner 70, the top portion 50*ut* of each of the upper distribution ridges extend straight. Thereby, the intermediate part 69 of the top portion 50*ut* is given an essentially constant width w, the width w being measured orthogonal to the top upper ridge line 54TR.

With reference to FIGS. 3*a*-3*b*, 5 and 7, a projection, in a first projection plane P1 (FIG. 2), of a plurality, here all, of the bottom portions 52*ub* of the upper distribution valleys 52*u* extending along the top upper valley line 56TV, is a mirroring, parallel to the longitudinal center axis L of the heat transfer plate 2*a*, of a projection, in the first projection plane P1, of the top portions 50*ut* of the upper distribution ridges 50*u* extending along the top upper ridge line 54TR. Further, also the upper distribution valleys 52*u* extending along the top upper valley line 56W comprise bottom portions 52*ub* having first and third corners 74, 78 of curvature radius r1 and r3, respectively, and second and fourth corners 76, 80 of curvature radius r2 and r4, respectively, wherein r1 and r3 are essentially larger than r2 and r4.

Here, the first projection plane P1 coincides with the central extension plane 42 of the heat transfer plate 2*a* but it may be different in alternative embodiments of the invention.

As said above, the lower end portion 16 is a mirroring, parallel to the transverse center axis T of the heat transfer plate 2*a*, of the upper end portion 8. Thus, also the lower distribution ridges 501 extending along the bottom lower ridge line 54BR and the lower distribution valleys 52*l* extending along the bottom lower valley line 56BV comprise top portions 50*lt* and bottom portions 52*lb* having first and third corners 64, 68, 74, 78 of curvature radius r1 and r3 and second and fourth corners 66, 70, 76, 80 of curvature radius r2 and r4, wherein r1 and r3 are essentially larger than r2 and r4.

As previously said, in the plate pack, the plate 2*a* is arranged between the plates 2*b* and 2*c*. The plates 2*b* and 2*c* may be arranged either "flipped" or "rotated" in relation to the plate 2*a*.

If the plates 2*b* and 2*c* are arranged "flipped" in relation to the plate 2*a*, the front side 4 and back side 6 of plate 2*a* face the front side 4 of plate 2*b* and the back side 6 of plate 2*c*, respectively. This means that the ridges of plate 2*a* will abut the ridges of plate 2*b* while the valleys of plate 2*a* will abut the valleys of plate 2*c*. More particularly, the heat transfer ridges 44 and heat transfer valleys 46 of the plate 2*a* will abut, in pointlike contact areas, the heat transfer ridges 44 of the plate 2*b* and the heat transfer valleys 46 of the plate 2*c*, respectively. Further, the upper and lower distribution ridges 50*u* and 501 of the plate 2*a* will abut, in elongate contact areas, the lower and upper distribution ridges 501 and 50*u*, respectively, of the plate 2*b*, while the upper and lower distribution valleys 52*u* and 52*l* of the plate 2*a* will abut, in elongate contact areas, the lower and upper distribution valleys 52*l* and 52*u*, respectively, of the plate 2*c*. Especially, the upper distribution ridges 50*u* along the top upper ridge line 54TR and the lower distribution ridges 501 along the bottom lower ridge line 54BR of the plate 2*a* will be aligned with and abut, the lower distribution ridges 501 along the bottom lower ridge line 54BR and the upper distribution ridges 50*u* along the top upper ridge line 54TR, respectively, of the plate 2*b*. Further, the upper distribution valleys 52*u* along the top upper valley line 56W and the lower distribution valleys 52*l* along the bottom lower valley line 56BV of the plate 2*a* will be aligned with and abut, the lower distribution valleys 52*l* along the bottom lower valley line 56BV and the upper distribution valleys 52*u* along the top upper valley line 56W, respectively, of the plate 2*c*.

Thus, the distribution channels of the plates will be aligned so as to form distribution flow tunnels between the distribution areas of the plates. The longest distribution flow channels will, closest to the port holes of the plates, be defined by more rounded distribution ridges and valleys, which will reduce the stagnant flow areas, and thus the fouling and dirt build-up, in the longest distribution flow channels.

If the plates 2*b* and 2*c* are arranged "rotated" in relation to the plate 2*a*, the front side 4 and back side 6 of plate 2*a* face the back side 6 of plate 2*b* and the front side 4 of plate 2*c*, respectively. This means that the ridges of plate 2*a* will abut the valleys of plate 2*b* while the valleys of plate 2*a* will abut the ridges of plate 2*c*. More particularly, the heat transfer ridges 44 and heat transfer valleys 46 of the plate 2*a* will abut, in pointlike contact areas, the heat transfer valleys 46 of the plate 2*b* and the heat transfer ridges 44 of the plate 2*c*, respectively. Further, the upper and lower distribution ridges 50*u* and 501 of the plate 2*a* will abut, in elongate contact areas, the lower and upper distribution valleys 52*l* and 52*u*, respectively, of the plate 2*b*, while the upper and lower distribution valleys 52*u* and 52*l* of the plate 2*a* will abut, in elongate contact areas, the lower and upper distribution ridges 501 and 50*u*, respectively, of the plate 2*c*. Especially, the upper distribution ridges 50*u* along the top upper ridge line 54TR and the lower distribution ridges 501 along the bottom lower ridge line 54BR of the plate 2*a* will be aligned with and abut, the lower distribution valleys 52*l* along the bottom lower valley line 56BV and the upper distribution valleys 52*u* along the top upper valley line 56TV, respectively, of the plate 2*b*. Further, the upper distribution valleys 52*u* along the top upper valley line 56W and the lower distribution valleys 52*l* along the bottom lower valley line 56BV of the plate 2*a* will be aligned with and abut the lower distribution ridges 501 along the bottom lower ridge line 54BR and the upper distribution ridges 50*u* along the top upper ridge line 54TR, respectively, of the plate 2*c*.

The above described heat transfer plate 2*a* illustrated in FIGS. 1 and 3*a*-3*b* is of parallel flow type which means that the inlet and outlet port holes for a first fluid are arranged on one side of the longitudinal center axis L of the heat transfer plate, while the inlet and outlet port holes for a second fluid are arranged on another side of the longitudinal center axis L of the heat transfer plate. In a plate pack of plates of parallel flow type, all plates may, but need not, be similar. According to an alternative embodiment of the invention, the heat transfer plate is of diagonal flow type which means that the inlet and outlet port holes for a first fluid are arranged on opposite sides of the longitudinal center axis L of the heat transfer plate, and the inlet and outlet port holes for a second fluid are arranged on opposite sides of the longitudinal center axis L of the heat transfer plate. A plate pack of plates of diagonal flow type typically comprises at least two different types of plates.

On a diagonal flow type plate the lower end portion is typically not a mirroring, parallel to the transverse center axis of the plate, of the upper end portion. Instead, the upper and lower distribution patterns may have a similar design. A heat transfer plate 2*d* (schematically illustrated in FIG. 2) of diagonal flow type according to one embodiment of the invention is designed as described above except for as regards the lower distribution area 22. More particularly, in the lower distribution area 22 the imaginary lower ridge lines 541 extend from the lower borderline 32 towards the fourth porthole 20 while the imaginary lower valley lines 561 extend from the lower borderline 32 towards the third porthole 18. Thereby, bottom lower ridge line 54BR becomes the imaginary lower ridge line arranged closest to the third porthole 18, while the bottom lower valley line 56BV becomes the imaginary lower valley line arranged closest to the fourth porthole 20.

A projection, in a second projection plane P2 (FIG. 2), of a plurality, here all, of the bottom portions 52*lb* of the lower distribution valleys 52*l* extending along the bottom lower valley line 56BV, is a mirroring, parallel to the transverse center axis T of the heat transfer plate 2*d*, of a projection, in the second projection plane P2, of the top portions 50*ut* of the upper distribution ridges 50*u* extending along the top upper ridge line 54TR. Further, also the lower distribution valleys 52*l* extending along the bottom lower valley line 56BV comprise bottom portions 52*ub* having first and third corners 74, 78 of curvature radius r1 and r3 and second and fourth corners 76, 80 of curvature radius r2 and r4, wherein r1 and r3 are essentially larger than r2 and r4.

Further, a projection, in the second projection plane P2, of a plurality, here all, of the top portions 50*lt* of the lower distribution ridges 501 extending along the bottom lower ridge line 54BR, is a mirroring, parallel to the transverse center axis T of the heat transfer plate 2*d*, of a projection, in the second projection plane P2, of the bottom portions 52*ub* of the upper distribution valleys 52*u* extending along the top upper valley line 56TV. Further, also the lower distribution ridges 501 extending along the bottom lower ridge line 54BR comprise top portions 50*ut* having first and third corners 64, 68 of curvature radius r1 and r3 and second and fourth corners 66, 70 of curvature radius r2 and r4, wherein r1 and r3 are essentially larger than r2 and r4.

Here, the second projection plane P2 coincides with the central extension plane 42 of the heat transfer plate 2*d* but it may be different in alternative embodiments of the invention.

In a plate pack of plates of diagonal flow type, the plate 2*d* is arranged between the plates 2*b* and 2*c*. The plates 2*b* and 2*c*, which are of the same type, are designed like the plate 2*d*, except for within the upper and lower distribution areas. More particularly, the upper and lower distribution areas of the plates 2*b* and 2*c* are mirrorings, parallel to longitudinal center axes of the plates, of the upper and lower distribution areas of the plate 2*d*. The plates 2*b* and 2*c* may be arranged either "flipped" or "rotated" in relation to the plate 2*d* so as to achieve the mutual plate abutment described above.

On the above described heat transfer plates 2*a*-2*d*, the distribution ridges and distribution valleys along the top upper and bottom lower ridge lines and the top upper and bottom lower valley lines have have top portions and bottom portions comprising an intermediate part having a constant width w. According to alternative embodiments of the present invention, the intermediate part instead has a varying width. As an example, the intermediate part could be bulging away from the respective closest port hole so as to give the top and bottom portions of the distribution ridges and distribution valleys the essential shape of half an oval or circle.

The above described embodiments of the present invention should only be seen examples. A person skilled in the art realizes that the embodiments discussed can be varied in a number of ways without deviating from the inventive conception.

For example, the heat transfer area may comprise other heat transfer patterns than the one described above. Further, the upper and lower distribution patterns need not be of chocolate type but may have other designs.

Some or all of the distribution ridges and valleys, and especially the distribution ridges and valleys arranged along the top and bottom, upper and lower, ridge and valley lines, need not be designed as illustrated in the figures but may have other designs.

The longer imaginary upper and lower ridge and valley lines need not be curved. Instead, all imaginary upper and lower, ridge and valley lines could be straight. As another example, also the shorter, i.e. all, imaginary upper and lower ridge and valley lines could be curved. Further, the upper and lower borderlines need not be curved but could have other forms. For example, they could be straight or zig-zag shaped.

The heat transfer plate could additionally comprise a transition band, like the ones described in EP 2957851, EP 2728292 or EP 1899671, between the heat transfer and distribution areas. Such a plate may be "rotatable" but not "flippable".

The present invention is not limited to gasketed plate heat exchangers but could also be used in welded, semi-welded, brazed and fusion-bonded plate heat exchangers.

The heat transfer plate need not be rectangular but may have other shapes, such as essentially rectangular with rounded corners instead of right corners, circular or oval. The heat transfer plate need not be made of stainless steel but could be of other materials, such as titanium or aluminium.

It should be stressed that the attributes front, back, upper, lower, first, second, etc. is used herein just to distinguish between details and not to express any kind of orientation or mutual order between the details.

Further, it should be stressed that a description of details not relevant to the present invention has been omitted and that the figures are just schematic and not drawn according to scale. It should also be said that some of the figures have been more simplified than others. Therefore, some components may be illustrated in one figure but left out on another figure.

The invention claimed is:

1. A heat transfer plate extending in an imaginary central extension plane and comprising an upper end portion, a center portion and a lower end portion arranged in succession along a longitudinal center axis of the heat transfer plate, the upper end portion comprising a first and a second port hole and an upper distribution area provided with an upper distribution pattern, the lower end portion comprising a third and a fourth port hole and a lower distribution area provided with a lower distribution pattern, and the center portion comprising a heat transfer area provided with a heat transfer pattern differing from the upper and lower distribution patterns, the upper end portion adjoining the center portion along an upper borderline and the lower end portion adjoining the center portion along a lower borderline, wherein the upper distribution pattern comprises elongate upper distribution ridges and elongate upper distribution valleys, a respective top portion of the upper distribution ridges extending in an imaginary upper plane and having a rounded first, a rounded second, a rounded third and a rounded fourth corner, and a respective bottom portion of the upper distribution valleys extending in an imaginary lower plane and having a rounded first, a rounded second, a rounded third and a rounded fourth corner, the upper distribution ridges longitudinally extending along a plurality of separated imaginary upper ridge lines extending from the upper borderline towards the first port hole, the upper distribution valleys longitudinally extending along a plurality of separated imaginary upper valley lines extending from the upper borderline towards the second port hole, for each of a first number>1 of the upper distribution ridges extending along a top upper ridge line of the upper ridge lines, which top upper ridge line is arranged closest to the second port hole, a curvature radius of the first corner of the top portion is larger than a curvature radius of the second corner of the top portion, the first and second corners being arranged on opposite sides of the top upper ridge line, the second corner being arranged closer to the second port hole than the first corner, and the first and third corners being arranged on the same side of the top upper ridge line.

2. The heat transfer plate according to claim 1, wherein said first number of the upper distribution ridges is a majority of the upper distribution ridges extending along the top upper ridge line.

3. The heat transfer plate according to claim 1, wherein, for each of said first number of the upper distribution ridges, a curvature radius of the third corner of the top portion is larger than a curvature radius of the fourth corner of the top portion.

4. The heat transfer plate according to claim 1, wherein, for each of said first number of the upper distribution ridges, the top portion, between the first and third corners, bulges towards the upper ridge line arranged second closest to the second port hole.

5. The heat transfer plate according to claim 1, wherein the top portion of each of said first number of the upper distribution ridges comprises a first end part, an intermediate part and a second end part arranged in succession along the top upper ridge line, wherein the first end part comprises the first and second corners and the second end part comprises the third and fourth corners, wherein the intermediate part has an essentially constant width, the width being measured orthogonal to the top upper ridge line.

6. The heat transfer plate according to claim 1, further comprising a front upper diagonal gasket groove portion arranged between the second port hole and the upper distribution area, a bottom of the front upper diagonal gasket groove portion extending in an imaginary front diagonal gasket plane, the upper distribution ridges, which extend along the top upper ridge line, protruding from the imaginary front diagonal gasket plane and extending along the front upper diagonal gasket groove portion so as to form an intermittent side wall of the front upper diagonal gasket groove portion.

7. The heat transfer plate according to claim 6, wherein said imaginary front diagonal gasket plane extends between the imaginary upper plane and the imaginary lower plane.

8. The heat transfer plate according to claim 1, wherein the imaginary upper ridge lines and the imaginary upper valley lines form a grid within the upper distribution area, wherein the upper distribution valleys and the upper distribution ridges defining each mesh of the grid enclose an area within which the heat transfer plate extends in an imaginary first intermediate plane extending between the imaginary upper plane and the imaginary lower plane.

9. The heat transfer plate according to claim 1, wherein a projection, in a first projection plane parallel to said central extension plane of the heat transfer plate, of the bottom portion of each of a plurality of the upper distribution valleys extending along a top upper valley line of the upper valley lines, which top upper valley line is arranged closest to the first port hole, is a mirroring, parallel to the longitudinal center axis of the heat transfer plate, of a projection, in said first projection plane, of the top portion of a respective one of said first number of the upper distribution ridges.

10. The heat transfer plate according to claim 1, wherein the first port hole and the third port hole are arranged at one and the same side of the longitudinal center axis of the heat transfer plate, and wherein the lower distribution pattern comprises elongate lower distribution ridges and elongate lower distribution valleys, the lower distribution ridges longitudinally extending along a plurality of separated imaginary lower ridge lines extending from the lower borderline towards one of the third and the fourth port holes, the lower distribution valleys longitudinally extending along a plurality of separated imaginary lower valley lines extending from the lower borderline towards the other one of the third and the fourth port hole, wherein a projection, in a second projection plane parallel to said central extension plane of the heat transfer plate, of a top portion or a bottom portion of each of a plurality of the lower distribution ridges and lower distribution valleys, is a mirroring, parallel to a transverse center axis of the heat transfer plate, of a projection, in said second projection plane, of the top portion of a respective one of said first number of the upper distribution ridges.

11. The heat transfer plate according to claim 10, wherein said one of the third and the fourth port hole is the third port hole and said other one of the third and the fourth port hole is the fourth port hole, and wherein each of a plurality of the lower distribution ridges extending along a bottom lower ridge line of the lower ridge lines, which bottom lower ridge line is arranged closest to the fourth port hole, is a mirroring, parallel to the transverse center axis of the heat transfer plate, of a respective one of said first number of the upper distribution ridges.

12. The heat transfer plate according to claim 10, wherein said one of the third and the fourth port hole is the fourth port hole and said other one of the third and the fourth port hole is the third port hole, and wherein a projection, in the second projection plane, of the bottom portion of each of a plurality of the lower distribution valleys extending along a bottom lower valley line of the lower valley lines, which bottom lower valley line is arranged closest to the fourth port hole, is a mirroring, parallel to the transverse center axis of the heat transfer plate, of a projection, in the second projection plane, of the top portion of a respective one of said first number of the upper distribution ridges.

13. The heat transfer plate according to claim 1, wherein a plurality of the imaginary upper ridge lines arranged closest to the second port hole, along at least part of their extension, are curved so as to bulge out as seen from the second port hole.

14. The heat transfer plate according to claim 1, wherein the upper and lower borderlines are curved so as to bulge in as seen from the heat transfer area.

* * * * *